United States Patent [19]

Hasler et al.

[11] 4,141,290

[45] Feb. 27, 1979

[54] PRINT HAMMER FOR TYPE PRINTERS

[75] Inventors: Werner Hasler, Schoenaich; Subramaniam Padmanabhan, Herrenberg, both of Fed. Rep. of Germany

[73] Assignee: International Business Machines Corporation, Armonk, N.Y.

[21] Appl. No.: 808,020

[22] Filed: Jun. 20, 1977

[30] Foreign Application Priority Data

Jul. 1, 1976 [DE] Fed. Rep. of Germany ..... 2629592

[51] Int. Cl.[2] ..... B41J 9/02

[52] U.S. Cl. ..... 101/93.48; 101/93.34

[58] Field of Search ..... 101/93.29–93.34, 101/93.48

[56] References Cited

U.S. PATENT DOCUMENTS

| | | | |
|---|---|---|---|
| 3,164,085 | 1/1965 | Hawkins | 101/93.33 |
| 3,417,690 | 12/1968 | Clark et al. | 101/93.33 |
| 3,504,623 | 4/1970 | Staller | 101/93.33 |
| 3,587,456 | 6/1971 | Jaensch | 101/93.31 |
| 3,832,942 | 9/1974 | Murayoshi | 101/93.33 X |
| 3,919,933 | 11/1975 | Potter | 101/93.32 |
| 3,996,852 | 12/1976 | Matsuzawa | 101/93.31 |

*Primary Examiner*—Edward M. Coven

*Attorney, Agent, or Firm*—Kenneth P. Johnson

[57] ABSTRACT

Print hammer actuating apparatus of the double lever type in which one lever is moved in response to an input force and carries a pivotally mounted second lever which provides the output force through either an "inertia" principle or "ratio" principle. The angular velocity of the first lever is multiplied through those principles to provide greater impact velocity at the output of the second lever without requiring an increase of the input energy.

8 Claims, 8 Drawing Figures

PRINT HAMMER FOR TYPE PRINTERS

BACKGROUND OF THE INVENTION

The invention relates to a print hammer for type printers, which is designed as a double-lever hammer. Such a double-lever hammer will be described both for the so-called inertia principle and the so-called ratio principle.

In known electro-magnetically operated print hammers the print hammer is designed as a single or a two-arm lever. Upon excitation of the electromagnet associated with the print hammer, this lever is attracted by the yoke of said magnet. During this, a print head arrangement at the end of the print hammer lever hits against a printing type to generate, via a ribbon, a type image on the paper arranged between print head and printing type.

Impact printers of this kind, in particular those used in connection with electronic data processing systems, require a very high printing capacity. Print hammers having a low mass and a correspondingly high acceleration and thus a high impact velocity at the moment of type printing fall short of this requirement. The higher the impact velocity, the less the risk of the printed image becoming slurred. However, in known print hammer arrangements an increase of the impact velocity is not possible without increasing the energy required for exciting the electromagnet associated with the print hammer. Therefore, it is the object of the invention to provide a print hammer which at constant excitation energy requirements of the electromagnet associated with this print hammer permits an increase in the impact velocity of the print head on the printing type.

SUMMARY OF THE INVENTION

This problem is solved in accordance with the invention by means of a double-lever arrangement operating according to the so-called "inertia principle" on the one hand and according to the so-called "ratio principle" on the other. The double-lever hammer arrangement operating according to the inertia principle is advantageously characterized in accordance with the invention in that it consists of two levers pivotable about one fulcrum each in the same plane of movement, the first or the second lever arm of the first lever being operable as an armature and the first or the second lever arm of the first lever being movable against a stop upon actuation of the armature, that the fulcrum of the second lever lies at the end of the second lever arm of the first lever, that the second lever has a first lever arm carrying the print head and a second lever arm which, when the lever moves against the stop, rests against said lever, and that when the first lever hits the stop, the first lever arm of the second lever, as a result of the inertial forces, is moved at increased angular velocity about its fulcrum in the direction of print, and that during this process, the angular velocity of the first lever arm of the second lever, which carries the print head, is higher in relation to its fulcrum than that of the print head in relation to the fulcrum of the first lever when the first lever moves against the stop.

The double-lever hammer arrangement in accordance with the ratio principle is characterized in that it consists of two levers pivotable about one fulcrum each in the same plane of movement, the first lever being operable as an armature and being movable against a stop, that the fulcrum of the second lever lies at the end of the first lever, that the second lever has a longer first lever arm, to whose end an actuating rod is pivoted for a single arm print hammer lever known per se, and a shorter second lever arm which is designed in such a manner that when the first lever hits the stop, it is deflected in a direction opposite to this direction of movement, so that the actuating rod pivoted to the first lever arm of the second lever is movable at increased velocity in the direction of print as referred to the velocity prior to deflection.

In accordance with the invention, the armature operated lever of the double-lever arrangement operating according to the inertia principle may be preferably designed as a single-arm lever. Similarly, the armature operated lever of the double-lever arrangement operating according to the ratio principle may be designed as a two-arm lever.

The lever pivoted during printing, which carries the print head or to which an actuating rod for a print hammer is pivoted, is returned to its original position in relation to the armature-operated lever by means of a return spring arranged between the two levers. The armature-operated lever operates, via a plunger, against a compression pressure spring. As a stop for the double-lever arrangement in the inoperative state an adjustable screw is provided.

In accordance with the invention, the double-lever arrangement for the inertia principle is preferably designed in such a manner that when the first lever 2 hits stop 11, the center of percussion of lever 2 coincides with its fulcrum 5 and that during type printing the center of percussion of the second lever 6 coincides with its fulcrum 9.

Typical representations and embodiments of the invention are shown in the drawings and will be described in detail below.

DESCRIPTION OF THE DRAWINGS

FIGS. 1A to 1C show typical representations of the double-lever hammer for the inertia principle in different positions wherein FIG. 1A shows the original position; FIG. 1B shows the motional phase; and FIG. 1C shows the print phase.

FIGS. 3A to 3C show a typical representation of the double-lever hammer for the ratio principle in different positions wherein FIG. 3A shows the original position; FIG. 3B shows the motional phase; and FIG. 3C shows the print phase.

DESCRIPTION OF THE PREFERRED EMBODIMENTS

Figure 1A:
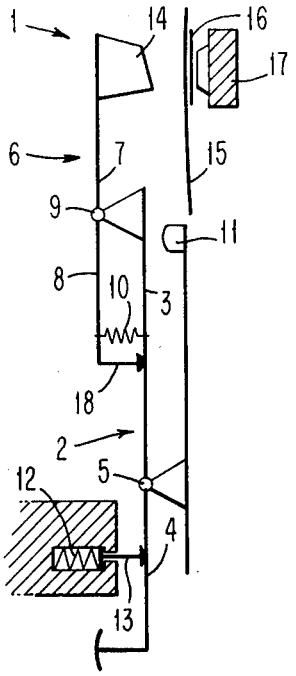
Figure 1B:
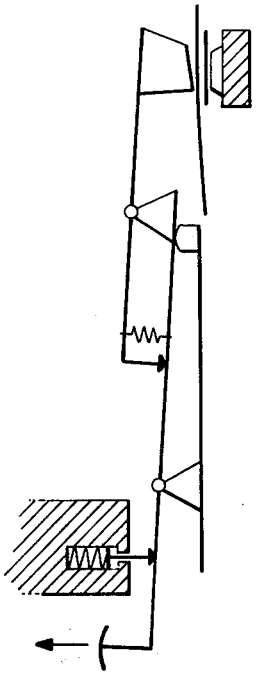
Figure 1C:
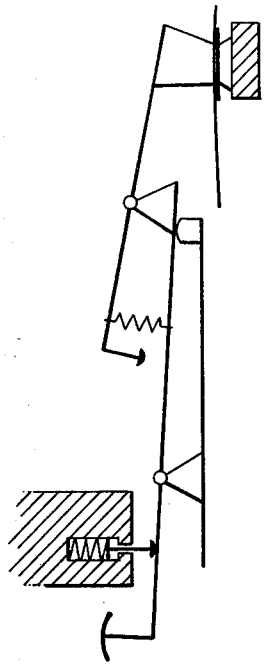
Figure 2:
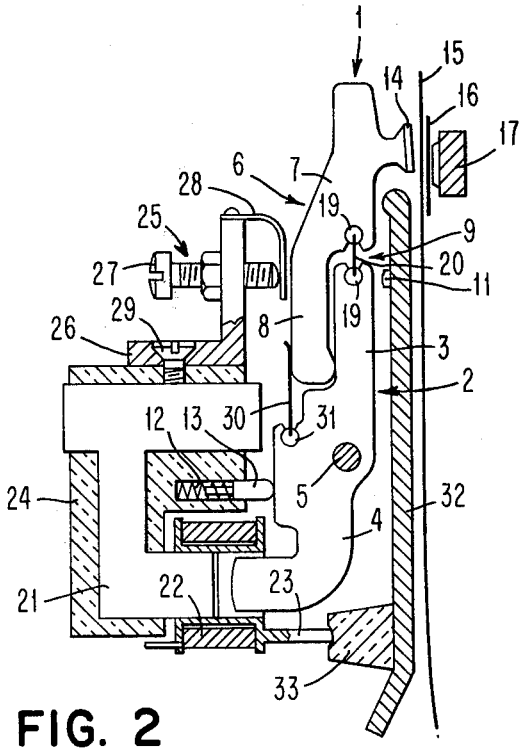
FIG. 2 shows an embodiment of the double-lever hammer for the inertia principle, depicting the original position.

For clarity's sake, the components corresponding to each other in FIGS. 1A to 1C and in FIG. 2 bear the same reference numberals. The same holds for FIGS. 3A to 3C and for FIG. 4.

The meaning of the numerals is:

2 = first lever with lever arms 3 and 4 and fulcrum 5
6 = second lever with lever arms 7 and 8 and fulcrum 9
11 = stop for lever arm 3
14 = print head
17 = printing type 16 = ribbon
15 = paper
10 = return spring
12 = pressure spring
13 = plunger FIGS. 1A to 1C show the double-lever hammer 1 for the inertia principle in different positions. Upon actuation of the double-lever hammer the following processes ensue: Lever arm 4 of lever 2 is attracted in the direction of the arrow (FIG. 1B) by the electromagnet (not shown) associated with this hammer. During this, lever 2 moves clockwise about its fulcrum 5 until its lever arm 3 hits stop 11. Fulcrum 9 for lever 6 lies at the top end of lever arm 3. As lever 2 is moved against stop 11, lever 6 is taken along by the inertial forces. At the moment of impact of lever arm 3 on stop 11, the inertial forces (resulting from the heavy print head at the upper end of lever arm 7) cause lever 6 to be pivoted clockwise about its fulcrum 9 (see FIG. 1C), whereby type printing takes place. During this process, print head 14 hits against paper 15, ribbon 16 and printing type 17.

After type printing, return spring 10 between lever arm 8 and lever arm 3 causes a return motion until the bent end 18 of lever arm 8 again rests against lever arm 3. Upon actuation of lever 2 by means of the print hammer magnet, plunger 13 compresses spring 12. After printing, this compression spring 12 causes the double-lever arrangement to be returned to its original position.

For printing according to the inertia principle, lever arm 7 together with print element 14 fixed to its upper end should have a higher moment of inertia than lever arm 8. This ensures that, as lever arm 3 hits stop 11, lever 6 is suddenly pivoted about its fulcrum 9. During this, lever arm 7 has a higher angular velocity in relation to fulcrum 9 than the double-lever arrangement 1 has in relation to fulcrum 5 during the motional phase before lever arm 3 hits stop 11. This higher angular velocity also leads to a higher impact velocity of the print head during type printing than would be obtainable by means of only one lever with fulcrum 5 and a correspondingly greater length of the lever arm (not shown) carrying print head 14.

FIG. 2 shows an embodiment of a double-lever hammer arrangement for the inertia principle. Lever arm 4 of lever 2, pivotable about axis 5, is attracted by yoke 21 when electromagnet 22/23 is actuated. During this, lever arm 3 is pivoted clockwise against stop 11. Fulcrum 9 at the upper end of lever 3 is formed by a leaf spring 20 fixed with its two ends in the plastic-filled recesses 19 at the upper end of lever arm 3. As lever arm 3 hits stop 11, lever 6 is pivoted clockwise about its fulcrum 9. Its lower lever arm 8 moves against the tension of a return spring 10 designed as a leaf spring 30. One end of this leaf spring is fixed in the plastic-filled recess 31 of lever 2; the free end of said leaf spring rests against lever arm 8. The printing process with regard to lever 6 is the same as that depicted in the typical representations of FIGS. 1A to 1C. As lever arm 3 is pivoted against stop 11, lever arm 4 is moved, via plunger 13, against the compression of spring 12. After printing, return spring 30 returns lever 6 to a position in relation to lever 2, as shown in FIG. 2. In addition, compression spring 12 acts on lever arm 4 via plunger 13 in such a manner that lever 2 moves counter-clockwise about its axis 5. This movement is limited by stop 25 for lever 6, which consists of adjustment screw 27 and the flexible angular piece 28. Paper guide plate 32 comprises, in addition to stop 11, a holding element 33 which, via a crosspiece, supports coil core 23 with winding 22 of the electromagnet and the appertaining yoke 21. At the corresponding points yoke 21 of the electromagnet is surrounded by a sheath 24 which accommodates compression spring 12 and plunger 13 in a recess provided for that purpose and which permits fixing stop 25 by means of screw 29 via angular piece 26.

Figure 3A:
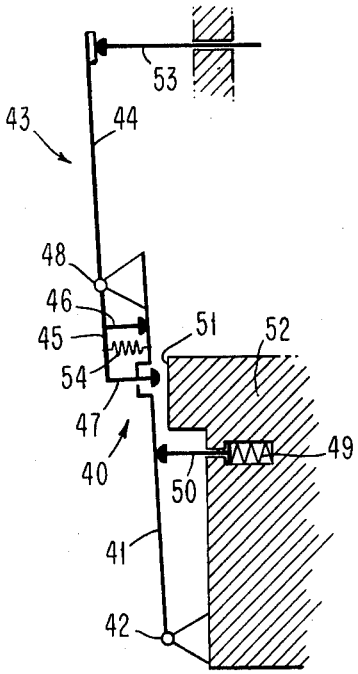
Figure 3B:
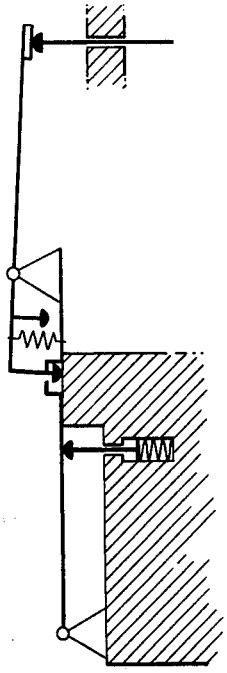
Figure 3C:
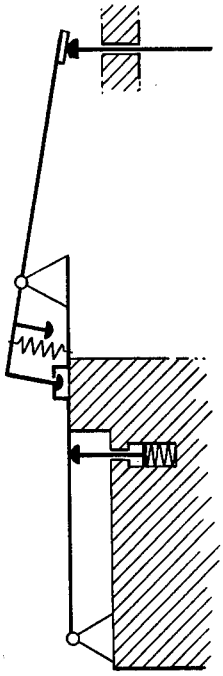
Figure 4:
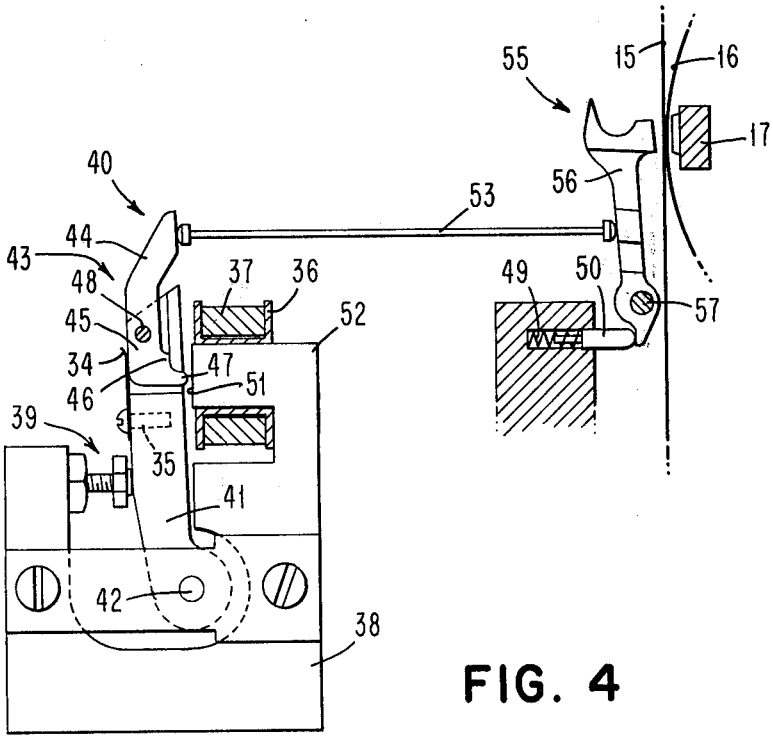
FIG. 4 shows an embodiment of the double-lever hammer for the inertia principle in the original position.

FIGS. 3A to 3C show a typical representation of a double-lever hammer 40, in different positions, for the so-called ratio principle. Double-lever hammer arrangement 40, as presented, is operated by an electromagnet, not shown, whose yoke is designated as 52. In this representation lever 41 is a single-arm lever with a fulcrum 42. (A two-arm lever would be equally suitable). Fulcrum 48 for the second lever 43 with lever arms 44 and 45 lies at the upper end of lever 41. An actuating rod 53 for an orthodox hammer arrangement 55 (as shown in FIG. 4) is fixed to the top end of lever arm 44. A pressure spring 49 in connection with a plunger 50 retains lever 41 in the original position shown in FIG. 3A. A return spring 54 arranged between lever arm 45 and lever 41 keeps lever 43 in relation to lever 41 in the position shown in FIG. 3A, the deflected arm element 46 of lever 43 resting against lever 41. Upon excitation of the print hammer magnet, double lever arrangement 40 is attracted by yoke 52, whereby a clockwise pivotal movement about 42 takes place. This movement is effected (via plunger 50) against the tension of pressure spring 49. A part of yoke 52 is designed as a stop 51. The lower part of lever arm 45 is bent in the form of a deflection arm 47 in such a manner that when double-lever arrangement 40 is moved clockwise during print hammer operation, said arm, as it hits stop 51 (see FIG. 3B), causes lever 43 to be pivoted clockwise about its fulcrum 48 against the force of return spring 54.

For the ratio principle, lever arm 44 must be longer than lever arm 45. As the lever ratio is the quotient of the lever arm lengths 44/45, the deflection on the upper end of lever arm 44 is greater than at the lower end of lever arm 45. Thus, the angular velocity of lever arm 44 in relation to fulcrum 48 is greater than the angular velocity of this lever arm 44 in relation to fulcrum 42, before deflection arm 47 is deflected on stop 51. This increased angular velocity also leads to an increased impact velocity of the hammer on the printing type. (For design and cost reasons the deflection rod 53 on the upper end of lever arm 44 does not directly carry the print head but merely serves to actuate a conventional print hammer arrangement).

FIG. 3C shows the double-lever arrangement in a position in which, as a result of inertial forces, the deflection of lever 44 about its fulcrum 48 exceeds that obtainable in accordance with the ratio principle. Type printing may take place in this position or in one of the positions in accordance with FIG. 3B.

FIG. 4 shows an embodiment of a double-lever hammer for the ratio principle described in FIGS. 3A to 3C. Lever 41 is pivotable about axis 42, and lever 43 is pivotable about axis 48 in the top part of the lever. A leaf spring 34, which on one end is fixed to lever 41 by means of a screw 35, serves as a return spring 54 to align lever 43 in relation to lever 41 for the original position. The other free end of the leaf spring rests against the outer surface of lever arm 45. Upon actuation of the elctromagnet (coil core 36, winding 37), the double-lever arrangement 40 is attracted by yoke 52. During this, the arrangement moves clockwise about axis 42. As deflection arm 47 of lever arm 45 hits stop 51, lever 41 is moved in the direction of stop 51, while lever 43 is deflected clockwise about its axis 48., While lever arm 44 moves about its fulcrum 48, the actuating rod 53 arranged on said lever acts on the actual print hammer 55. Print hammer 56 is pivotable about its fulcrum 57 under the influence of actuating rod 53, in order to cause printing type 17 to be printed on paper 15 via ribbon 16. The print hammer is deflected via plunger 50 against compression spring 49. As a stop element for the original position of lever arrangement 40 an adjustable screw 39 is provided which is arranged on a holding element 38 connected to yoke 52.

Lever 2 (FIGS. 1A to 1C, FIG. 2) may also be designed as a single-arm lever; similarly, lever 41 (FIGS. 3A to 3C, FIG. 4) may be designed as a two-arm lever. With all two-arm levers it is, of course, possible to have either the upper or the lower arm attracted by the yoke of the print hammer electromagnet.

The double-lever arrangement in accordance with the inertia principle is to be designed in such a manner that when the first lever 2 hits stop 11, the center of percussion of lever 2 coincides with its fulcrum 5 and that during type printing the center of percussion of the second lever 6 coincides with its fulcrum 9. The center of percussion is that point which remains free from reaction forces when the lever hits the stop.

When the double-lever arrangement in accordance with the inertia principle is designed, care must be taken that the distance ratio of the two fulcrums 5, 9 of the two levers 2, 6 to the distance of fulcrum 9 of the second lever 6 in relation to the print head center is greater than 1. In accordance with the energy conservation theorem, a velocity increase of say 41% is obtainable at a ratio of 2.

What is claimed is:

1. In a printer, impacting apparatus comprising:

a first lever pivotally mounted for movement between a first retracted position and a first extended position;

a second lever pivotally mounted on said first lever movable between a second retracted position and a second extended position, and so located that said second lever has formed first and second lever arms with said second lever arm having an impact portion and a greater mass than said first lever arm;

biasing means for resiliently urging each said lever to its respective retracted position;

stop means engageable by said first lever when moved to said first extended position; and means for moving said first lever into engagement with said stop means so that the momentum of said second lever arm of said second lever rotates said second lever and said impact portion to said second extended position.

2. Apparatus as described in claim 1 wherein the pivot supporting said first lever lies at a point intermediate the two ends of said first lever to thereby form a first lever arm on said first lever engageable by said moving means and a second lever arm on said first lever supporting the pivot for said second lever and wherein said second lever arm of said first lever engages said stop means in said first extended position.

3. Apparatus as described in claim 1 wherein said moving means is an electromagnetic actuator and said pivot supporting said second lever is a resilient element.

4. Apparatus as described in claim 1 wherein the pivotal mounting of second lever on said first lever comprises a spring.

5. In a printer, impacting apparatus comprising:

first and second levers, each pivotally mounted for movement between retracted and extended positions in a common plane with said second lever pivotally supported on said first lever located so that said second lever has formed first and second lever arms, said second lever arm having an impact portion thereon;

biasing means for resiliently urging each said lever to a said retracted position;

stop means engageable by said first lever arm of said second lever; and means for moving said first lever to its said extended position and engage said first lever arm of said second lever with said stop means to rotate said second lever about its pivot on said first lever to move said impact portion to an extended position.

6. Apparatus as described in claim 5 wherein the first and second lever arms of said second lever are proportioned about the pivot of said second lever so that the velocity of the first lever arm about said second lever pivot due to engagement of said stop means produces a greater angular velocity of the impact portion of said second lever arm about said second lever pivot than the angular velocity of said second lever arm about the pivot of said first lever before engagement of said first lever arm with said stop means.

7. Apparatus as described in claim 6 further including print hammer means extended to an impact position by said second lever arm during its motion from said retracted to said extended positions.

8. Apparatus as described in claim 7 wherein said first lever is pivoted about one end thereof and is moved to its extended position by an electromagnetic actuator.

* * * * *